US006213031B1

(12) United States Patent
Künzli et al.

(10) Patent No.: US 6,213,031 B1
(45) Date of Patent: Apr. 10, 2001

(54) METHOD OF COOLING A GRATE FOR A FURNACE AND GRATE FOR A FURNACE

(75) Inventors: Max Künzli, Boswil (CH); John Millard, London (GB); Peter Serck-Hanssen, Zürich (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/391,402

(22) Filed: Sep. 8, 1999

(30) Foreign Application Priority Data

Sep. 15, 1998 (EP) ..... 98810918

(51) Int. Cl.[7] ..... F23B 7/00; F23H 7/08; F23K 3/08

(52) U.S. Cl. ..... 110/341; 110/298; 110/278; 110/268; 110/281; 110/327; 126/174; 126/175

(58) Field of Search ..... 126/174, 175, 126/168; 110/268, 278, 281, 298, 328, 327, 341, 299, 300, 306, 311, 312, 313, 309, 310, 285

(56) References Cited

U.S. PATENT DOCUMENTS

| | | | | |
|---|---|---|---|---|
| 4,876,972 | * | 10/1989 | Mrklas | 110/298 |
| 5,245,983 | * | 9/1993 | Krieger | 126/163 R |
| 5,617,801 | * | 4/1997 | Hauser et al. | 110/282 |
| 5,775,238 | * | 7/1998 | Hauser | 110/282 |
| 5,882,189 | * | 3/1999 | Fehsenmayr et al. | 432/78 |
| 5,899,150 | * | 5/1999 | Martin et al. | 110/268 |
| 5,913,274 | * | 6/1999 | Kunzli et al. | 110/328 |
| 6,024,031 | * | 2/2000 | Stiefel | 110/281 |

FOREIGN PATENT DOCUMENTS

| | | |
|---|---|---|
| 335604 | 8/1926 | (BE) . |
| 4400992C1 | 5/1995 | (DE) . |
| 0393970A2 | 10/1990 | (EP) . |
| 0621449B1 | 8/1995 | (EP) . |
| 0713056A1 | 5/1996 | (EP) . |
| 690039 | 9/1930 | (FR) . |

* cited by examiner

*Primary Examiner*—Denise L. Ferensic
*Assistant Examiner*—K. B. Rinehart
(74) *Attorney, Agent, or Firm*—Burns, Doane, Swecker & Mathis, L.L.P.

(57) ABSTRACT

To cool a grate having alternately fixed and movable rows (1, 1') of grate bars (2), cooling liquid is sprayed into cavities (7), open at the bottom, of the grate bars (2) from spray tubes (10) situated in the underblast region (8) and in the process vaporizes essentially completely, so that the heat of vaporization is extracted from the grate bars (2). The angle sector (12) into which the cooling liquid is sprayed may be set in such a way that in each case only those sections of the grate bars (2) whose top sides form the free surface of the grate are sprayed. The cavities may also be closed except for a discharge opening leading into the underblast region and may be connected to a supply reservoir, in which the liquid is kept at a constant level, which is just below the discharge openings.

13 Claims, 3 Drawing Sheets

METHOD OF COOLING A GRATE FOR A FURNACE AND GRATE FOR A FURNACE

BACKGROUND OF THE INVENTION

1. Field of the Invention

The invention relates to a method of cooling a grate for a furnace and to a grate for a furnace. Grates of the generic type are used in furnaces, e.g. of refuse-incineration plants. The cooling is effected for the purpose of increasing their useful life by reducing the scaling of the grate material under the action of the combustion heat.

2. Discussion of Background

Thus it is known, for instance, from DE-A-44 09 992 to cool a grate bar by water which is directed through a passage which is run in the longitudinal direction from the rear end of the grate bar up to the tip and back through the grate bar. The effect of this type of cooling is restricted by the convective heat transfer and by the heat-absorption capacity of the water, as results from its thermal capacity and the temperature range available. The temperature of the cooling water must be kept below the boiling point, a factor which requires a relatively high velocity of flow to be maintained in the entire volume. The manufacture of the grate bars is thus inevitably relatively complicated and the cooling arrangement which maintains the cooling-water circulation is costly.

EP-B-0 621 449 discloses a similar design of a grate, in which, however, the grate bars of one row are in each case replaced by a continuous grate plate. Here, sufficient cooling with relatively low heating of the cooling water is ensured by large cross sections of flow, but this again requires a large cooling-water flow rate, which in turn can only be maintained by an expensive cooling arrangement.

SUMMARY OF THE INVENTION

Accordingly, one object of the invention is to specify an effective method of cooling a grate as well as a grate which is especially suitable for the cooling method according to the invention.

In the method according to the invention, the cooling liquid fed to the grate is converted essentially completely into vapor upon contact with the grate, as a result of which it can draw off very large quantities of heat at a low consumption, since both the heat transfer is substantially improved and the heat quantity absorbed during the vaporization is far greater than could be absorbed by mere heating in the liquid state of aggregation. The vapor produced need not be recirculated, but may flow off, for instance, into the region situated below the grate. This permits the use of grates and cooling arrangements of very simple construction. Nonetheless, the heat absorbed by the vapor may be at least partly recovered in the course of the heat recovery from the flue gas.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
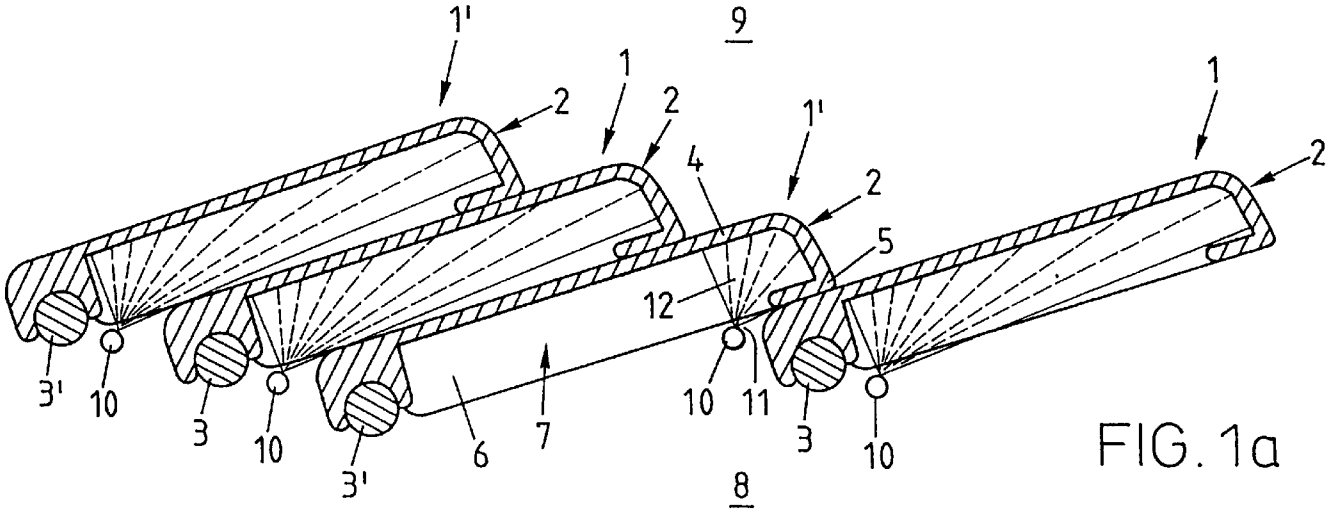
FIG. 1*a* shows a longitudinal section through a section of a grate according to the invention in a first embodiment in a first position.
Figure 1B:
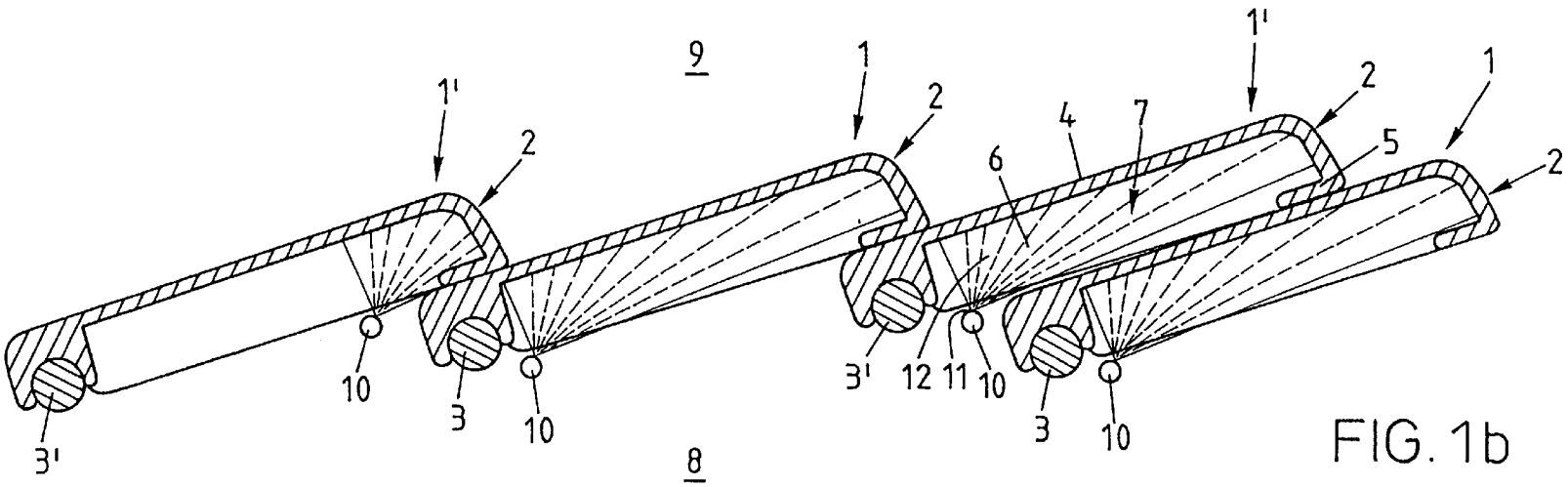
FIG. 1*b* shows a longitudinal section in accordance with FIG. 1*a* with the grate in a second position.

Referring now to the drawings, wherein like reference numerals designate identical or corresponding parts throughout the several views, a grate according to the invention in a furnace of a refuse-incineration plant has (FIGS. 1*a, b*), in a known manner in a first embodiment, a plurality of rows 1, 1', following one another in an overlapping manner in the longitudinal direction, of relatively narrow grate bars 2, which are arranged side by side and the rear ends of which are each supported on a transversely running carrying rod 3; 3', whereas the front end rests on a grate bar of the respectively leading row. The carrying rods 3, 3' are in each case designed to be alternately fixed and movable, i.e. displaceable forward and backward. Thus the fixed carrying rods 3 carry fixed rows 1 of grate bars 2, while the movable carrying rods 3' otherwise carry identical movable rows 1' of grate bars 2. Successive carrying rods 3' are in each case moved in opposition, as can be seen from FIGS. 1*a*, 1*b*, which show the opposed limit positions in the sequence of movement.

Each of the grate bars 2 has an upper covering wall 4, which is drawn downward at its front end and bent over into a sliding shoe 5, sliding along the top side of the respectively leading grate bar, and adjoining which are side walls 6, drawn laterally downward, so that the covering wall 4 and the side walls 6 enclose a cavity 7 open at the bottom. The grate bars 2 are of simple form and therefore can be produced in one piece and are accordingly inexpensive.

A spray device, which consists of transversely running, fixed spray tubes 10, of which one each is assigned to a row 1, 1' of grate bars 2, is arranged in the underblast region 8, which lies below the grate and into which primary air is also directed, this primary air passing through gaps between the grate bars 2 or openings in the latter into the furnace 9 lying above the grate. The spray tubes 10 have successive spray nozzles 11, which spray water as cooling liquid into a certain angle sector 12, which is essentially uniform over the width of the grate.

The angle sector 12 is in each case set in such a way that, at the grate bars 2 which belong to a fixed row 1, essentially the entire underside of the covering wall 4 is sprayed, whereas, at grate bars 2 which belong to a movable row 1', this is only the case when they are located in their advanced limit position. If they are retracted from this limit position, the spatially fixed angle sector 12 merely covers a decreasing front section of the covering wall 4. However, this is not troublesome, since the rear section which is not covered is in each case concealed from the furnace 9 by a grate bar 2 of the following fixed row 1. That part of the covering wall 4 whose top side forms part of the free surface of the grate is always sprayed and is thus covered by the cooling.

The feed of cooling water to the grate is set in such a way that it vaporizes at least more or less completely in each case upon contact with the grate bars 2, so that the cooling effect achievable from the heat of vaporization is essentially fully utilized. The vapor thereby produced in the underblast region 8 will generally pass partly or completely with the primary air into the furnace 9. The heat of vaporization contained in said vapor may then likewise be recovered in the course of the heat recovery from the flue gas. However, it is also possible to allow at least some of the vapor in the underblast region 8 to condense on cooled surfaces or to draw it off from the underblast region and feed it to a condenser and thus separate the vapor and, for example, feed it back to the cooling-water circuit and at the same time directly recover the heat of vaporization.

Figure 2A:
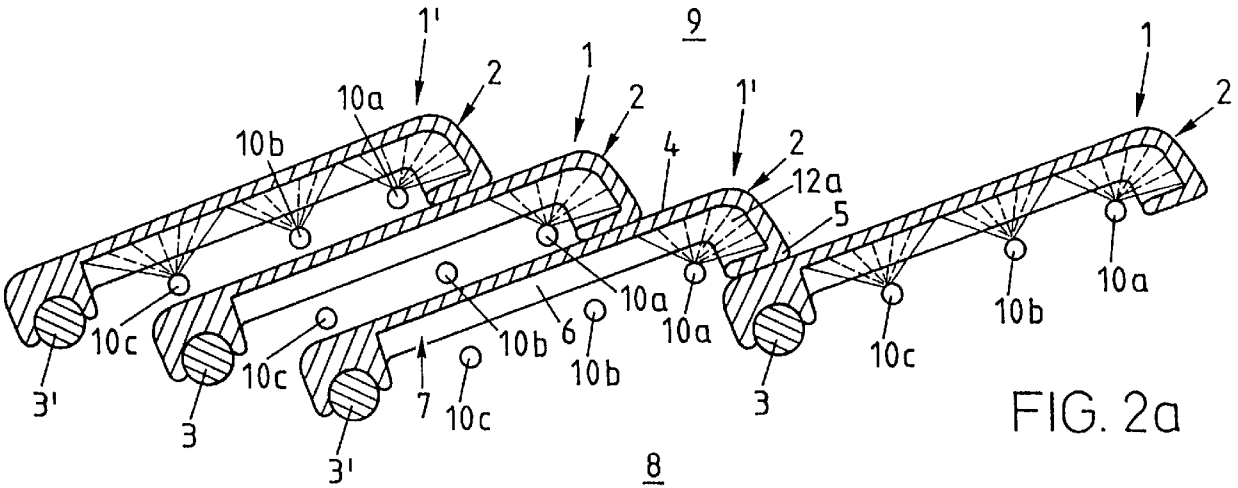
FIG. 2*a* shows a longitudinal section through a section of a grate according to the invention in a second embodiment in a first position.
Figure 2B:
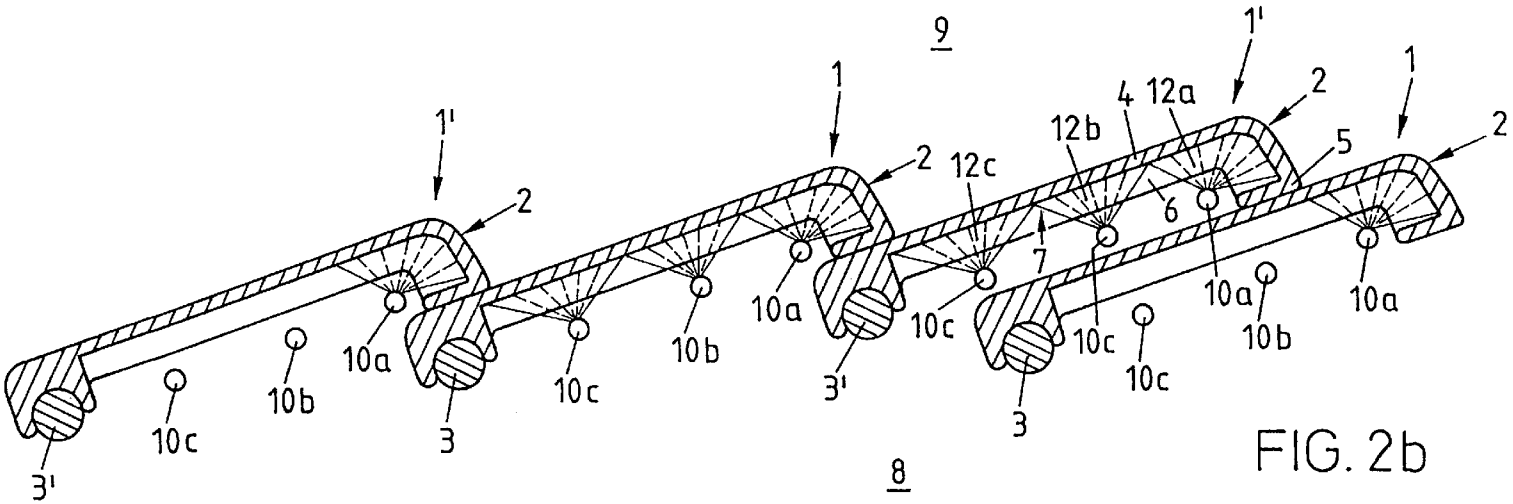
FIG. 2*b* shows a longitudinal section in accordance with FIG. 2*a* with the grate in a second position.

In a second embodiment (FIGS. 2*a, b*), the grate corresponds in most of the essential features to that described in connection with the first embodiment. However, the spray device consists in each case of three transversely running spray tubes 10*a, b, c* per row 1, 1' of grate bars 2, which in each case run close below the covering wall 4 of each grate bar 2 and are in each case fixed with respect to the corresponding row 1, 1' of grate bars 2, i.e. the spray tubes 10*a, b, c* assigned to a fixed row 1 are likewise arranged in a spatially fixed manner, but the spray tubes 10*a, b, c* assigned to a movable row 1' are connected to the latter or to the transverse rod 3' supporting it in such a way that they are moved along.

The spray tubes 10*a, b, c* again spray cooling water through spray nozzles into solid-angle sectors 12*a, b, c*, which are set in such a way that they in each case cover adjoining regions of the underside of the covering wall 4 in a slightly overlapping manner. The spray device is controlled in such a way that only the frontmost spray tubes 10*a* are in each case continuously in operation, whereas the rear spray tubes 10*b*, 10*c* are in each case shut off if those regions of the grate bars 2 of a row 1, 1' which are sprayed by them are in any case precisely concealed from the furnace 9 by grate bars 2 of the following row 1'; 1. In this case, therefore, with the grate bars 2 belonging to both a fixed row 1 and a movable row 1', essentially only that section of the covering wall 4 whose top side precisely forms part of the grate surface exposed in the furnace 9 is cooled. In this way, it is possible to keep the consumption of cooling water especially low and achieve very uniform cooling.

Figure 3:
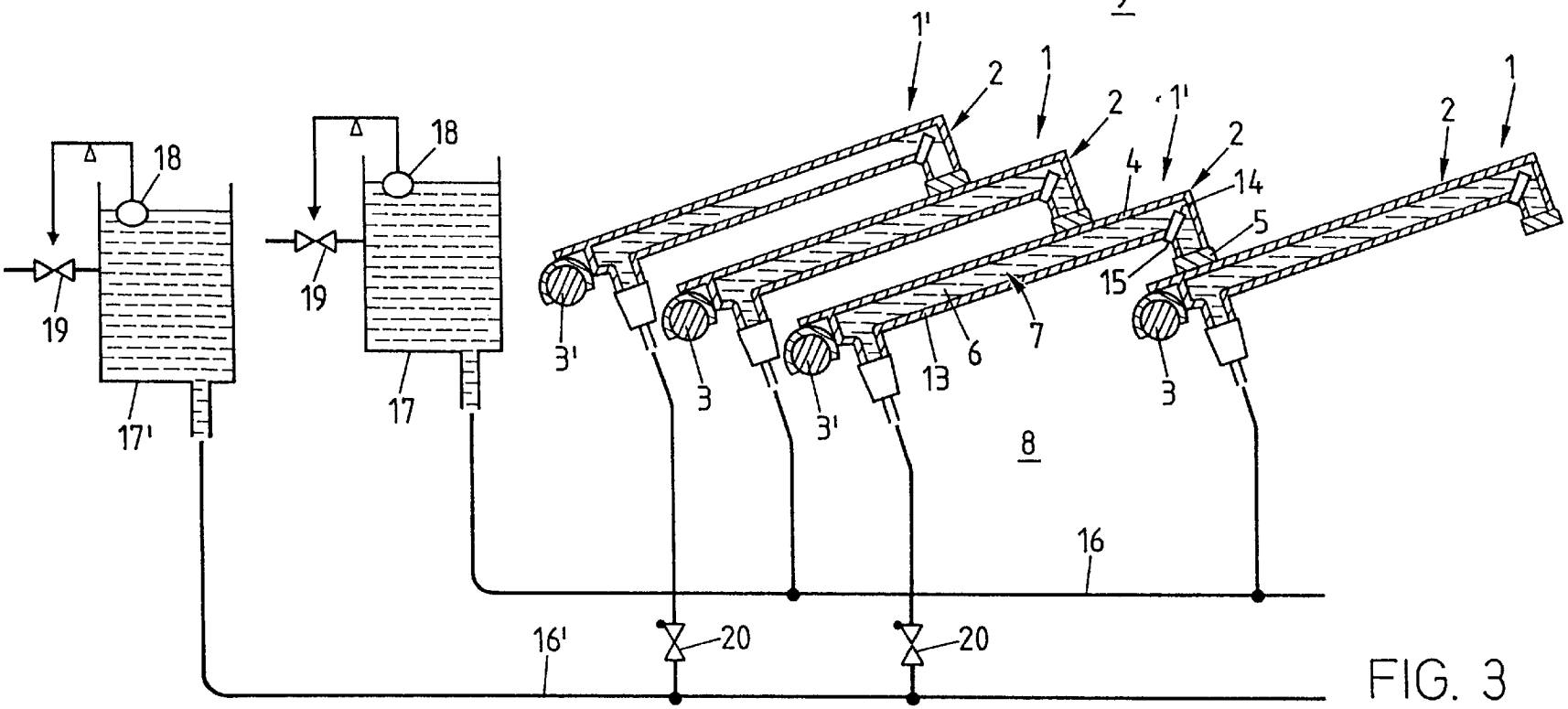
FIG. 3 shows a longitudinal section through a section of a grate according to the invention in a third embodiment with a schematically shown cooling system.

In a third embodiment (FIG. 3), which otherwise corresponds to the first and second embodiments, the grate bars 2 are each welded together from a plurality of parts, in particular they are of double-walled design, i.e. a bottom wall 13, which closes the cavity 7 from the underblast region 8, runs parallel to and at a distance from the covering wall 4. However, it is open toward the underblast region 8 inasmuch as it has a discharge opening 14 in its highest region, which lies in the front end region of the rising grate bar 2, the discharge opening 14 being formed by the orifice of a short tube connection 15 leading into the underblast region 8.

Via an enclosed pipeline 16 leading into the cavities 7, the grate bars 2 of the fixed rows 1, which all lie at the same level, are connected to a first supply reservoir 17, the water level of which, by means of a float 18 and a refill valve 19 controlled as a function of the position of the float 18, is kept constant in a manner known per se, specifically at a level which is just below the discharge opening 14. The losses caused in each grate bar 2 by vaporizing of the cooling water and outflow of the vapor through the discharge opening 14 are immediately compensated for by afterflow of cooling water from the supply reservoir 17, and the water level in the grate bar 2 is kept constant.

Via an enclosed hoseline 16' leading into the cavities 7 of the grate bars 2 or via a combined pipe and hoseline, which contains a check valve 20 for each movable row 1' or also for each of the two groups of identically moving rows 1' of grate bars 2, the grate bars 2 of the movable rows 1', which in the rear limit position likewise lie at the same level, are in each case connected to a second supply reservoir 17', the water level of which is kept constant in the same way as in the first supply reservoir 17. The water level is just below the discharge opening 14 of the grate bar 2 if the latter, as indicated at the second grate bar from the right, is located in the rear limit position.

If the grate bar 2 is pushed forward out of this position and thus also slightly upward, the check valve 20 closes, so that backflow from the grate bar 2 is prevented. The fact that the water level in the grate bar 2 nonetheless drops is due solely to the vaporization of cooling water in the cavity 7, this vaporization occurring in particular along the covering wall 4. The vapor flows upwards in the cavity 7 and escapes through the discharge opening 14 into the underblast region 8. For this reason, the water level is clearly below the discharge opening 14 in the front limit position, as indicated at the grate bar on the left on the outside. If no vaporization were to occur, the water level would remain at the level indicated by broken lines. If the grate bar 2 is then retracted, the check valve 20 opens as soon as the water level drops below that in the supply reservoir 17', and the grate bar 2 fills up again until the water level in the rear limit position is again just below the discharge opening 14.

The cooling arrangement only needs a very simple control, which may also be composed of purely mechanical means. It may therefore be produced in a very favorable manner and needs very little maintenance.

Many modifications of the grates described are conceivable within the scope of the invention. Thus, for instance, the side walls of the grate bars may be omitted, so that in each case a cavity extends over the entire row of grate bars. It is also conceivable for the rows of grate bars to be designed in one piece in each case, so that they form a continuous grate plate. The method according to the invention may also be modified in many ways. In particular, it may also be carried out with grates other than according to the invention. Thus the cooling-water circuit, instead of being open as described in connection with the exemplary embodiments of grates according to the invention, may also be closed, i.e. a return line may also be provided from each grate bar, through which return line the vapor is discharged from the cavity and fed, for instance, to a condenser and returned again in liquid form into the cooling-water circuit, while the heat recovered is utilized elsewhere.

Obviously, numerous modifications and variations ations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method of cooling a grate in a furnace, comprising the steps of:

providing a grate having overlapping rows of grate bars, said rows of grate bars being arranged side by side and alternately movable and fixed;

feeding cooling liquid to the grate bars, wherein the cooling liquid fed vaporizes essentially completely upon contact with the grate; and extracting the heat of vaporization from the grate.

2. The method as claimed in claim 1, wherein the cooling liquid is fed to the grate from below.

3. The method as claimed in claim 2, wherein cooling liquid is fed in each case only to those parts of the grate which form free surfaces of the grate which are formed by varying parts of said movable rows of the grate bars.

4. A grate for a furnace, having a plurality of successive rows of grate bars and a cooling-liquid feed, which in each case leads into a cavity of an individual grate bar or of a row of grate bars, wherein the cavity is in each case open in particular at the bottom to an underblast region wherein the grate bars are of single-walled design having cavities open essentially completely at the bottom, and the cooling-liquid feed is designed as a spray device arranged below the grate bars and having spray nozzles directed toward the undersides of the grate bars.

5. The grate as claimed in claim 4, wherein the spray nozzles are arranged in a fixed position.

6. The grate as claimed in claim 4, wherein the rows of grate bars are partly displaceable forward and backward in the longitudinal direction, and the spray nozzles directed toward undersides of the grate bars are displaceable with the grate bars in each case.

7. A grate for a furnace, having a plurality of successive rows of grate bars and a cooling-liquid feed, which in each case leads into a cavity of an individual grate bar or of a row of grate bars, wherein the cavity is in each case open in particular at the bottom to an underblast region wherein the grate bars are of a double-walled design, so that each grate bar contains a cavity into which a cooling-liquid feed opens and which has at least one discharge opening, which is open to the underblast region.

8. The grate as claimed in claim 7, wherein the at least one discharge opening is arranged in the highest region of the cavity.

9. The grate as claimed in claim 7, wherein the discharge opening leads to the underside of the grate bar.

10. The grate as claimed in claims 7, wherein the cooling-liquid feed is in each case designed as a pipeline or hoseline.

11. The grate as claimed in claim 10, wherein the pipeline or hoseline in each case starts from a supply reservoir, the water level of which is controlled to a level which is always below the discharge opening.

12. The grate as claimed in claim 10, wherein the rows of grate bars are alternately fixed and displaceable backward and forward in the longitudinal direction, in which case the grate bars are also raised during the forward displacement, and the connection of the grate bars of a movable row to the corresponding supply reservoir is in each case made via a check valve.

13. A grate for a furnace, comprising:

a plurality of successive rows of grate bars;

a cooling-liquid feed, which in each case leads into a cavity of an individual grate bar or of a row of grate bars, wherein the cavity of an individual grate bar or of a row of grate bars is in each case open in particular at the bottom at an underblast region;

said grate bars being of single-walled design having cavities open essentially completely at the bottom, and the cooling-liquid feed is designed as a spray device arranged below the grate bars and having spray nozzles directed toward the undersides of the grate bars;

wherein the rows of grate bars are partly displaceable forward and backward in a longitudinal direction of the grate, and the spray nozzles directed toward undersides of the grate bars are displaceable with the grate bars in each case.

* * * * *